US009470202B2

(12) United States Patent
Torrisi et al.

(10) Patent No.: US 9,470,202 B2
(45) Date of Patent: Oct. 18, 2016

(54) CONTROL APPARATUS OF AN IGNITION SPARK PLUG AND ENGINE ELECTRONIC IGNITION SYSTEM HAVING OPEN SECONDARY PROTECTION

(71) Applicant: STMicroelectronics S.r.l., Agrate Brianza (MB) (IT)

(72) Inventors: GiovanniLuca Torrisi, Aci Catena / Catania (IT); CalogeroAndrea Trecarichi, Aci Catena (CT) (IT)

(73) Assignee: STMICROELECTRONICS S.R.L., Agrate Brianza (MB) (IT)

( * ) Notice: Subject to any disclaimer, the term of this patent is extended or adjusted under 35 U.S.C. 154(b) by 438 days.

(21) Appl. No.: 14/097,852

(22) Filed: Dec. 5, 2013

(65) Prior Publication Data

US 2014/0188369 A1 Jul. 3, 2014

(30) Foreign Application Priority Data

Jan. 3, 2013 (IT) ..... MI2013A0002

(51) Int. Cl.

| | |
|---|---|
| ***F02P 3/05*** | (2006.01) |
| ***F02P 9/00*** | (2006.01) |
| ***F02P 3/055*** | (2006.01) |
| ***F02P 17/12*** | (2006.01) |

(52) U.S. Cl.

CPC ..... *F02P 9/00* (2013.01); *F02P 3/051* (2013.01); *F02P 3/0552* (2013.01); *F02P 17/12* (2013.01); *F02P 2017/121* (2013.01)

(58) Field of Classification Search

CPC ..... F02P 9/00; F02P 9/002; F02P 7/06; F02P 11/02; F02P 11/06; F02P 3/051; F02P 3/0552; F02P 3/0554; F02P 17/12; F02P 2017/121; F02P 1/083; F02D 2041/2058; F02D 37/02

USPC ..... 320/660, 662

See application file for complete search history.

(56) References Cited

U.S. PATENT DOCUMENTS

| | | | | |
|---|---|---|---|---|
| 5,140,970 | A * | 8/1992 | Akaki | F02P 3/053 123/620 |
| 5,418,461 | A * | 5/1995 | Maeda | F02P 17/12 123/479 |
| 5,790,039 | A * | 8/1998 | Palara | F02P 17/12 123/479 |
| 7,686,000 | B2 * | 3/2010 | Garrard | F02P 3/053 123/609 |
| 2004/0200463 | A1 | 10/2004 | Ando | |
| 2004/0255920 | A1 * | 12/2004 | Torrisi | F02P 7/035 123/640 |

(Continued)

FOREIGN PATENT DOCUMENTS

| | | |
|---|---|---|
| DE | 40 20 986 | 1/1992 |
| DE | 41 20 935 | 1/1992 |

(Continued)

*Primary Examiner* — Lindsay Low
*Assistant Examiner* — George Jin
(74) *Attorney, Agent, or Firm* — Allen, Dyer, Doppelt, Milbrath & Gilchrist, P.A.

(57) ABSTRACT

A control apparatus of an engine ignition spark plug includes a switch having a control terminal and an output terminal connected to an external transformer. The switch assumes a closed state for supplying energy to the transformer, and an open state for the transformer to supply energy to the spark plug. A measuring module measures a time duration where, in the open state, a voltage at the output terminal of the switch decreases from a first value to a second value. A detecting module detects an operating condition of the spark plug based on comparing the measured time duration to a time threshold, and to generate a detecting signal based on the comparing.

19 Claims, 5 Drawing Sheets

(56) References Cited

U.S. PATENT DOCUMENTS

| | | | | |
|---|---|---|---|---|
| 2005/0061306 | A1* | 3/2005 | Naruse | F02P 3/051 123/618 |
| 2008/0011281 | A1* | 1/2008 | Kraus | F02P 3/051 123/623 |
| 2008/0197717 | A1* | 8/2008 | Lorenzo | F02P 3/053 307/139 |
| 2010/0242583 | A1* | 9/2010 | Chesney | F02P 11/06 73/114.62 |
| 2013/0335864 | A1* | 12/2013 | Trecarichi | F02P 3/051 361/36 |
| 2016/0084214 | A1* | 3/2016 | Okuda | F02D 37/02 123/478 |

FOREIGN PATENT DOCUMENTS

| | | |
|---|---|---|
| DE | 198 60 377 | 6/2000 |
| EP | 740 072 | 10/1996 |

* cited by examiner

CONTROL APPARATUS OF AN IGNITION SPARK PLUG AND ENGINE ELECTRONIC IGNITION SYSTEM HAVING OPEN SECONDARY PROTECTION

FIELD OF THE INVENTION

The present invention relates to a control apparatus of an engine ignition spark plug, such as for a motor vehicle.

BACKGROUND OF THE INVENTION

To provide an electronic ignition for internal combustion engines, such as Otto cycle (i.e., four-stroke) engines, circuits with a switch, a spark plug, and a transformer connected across the spark plug and switch may be used. Typically, the switch may be implemented by a solid-state component, such as an IGBT transistor or Darlington configuration bipolar transistors (i.e., a Darlington configuration transistor).

Electronically closing the solid-state switch using a control signal allows current to flow through the primary winding of a transformer that charges with an energy equal to $L*I^2/2$. The variable L is the inductance value of the primary winding, and the variable I is the current flowing through it.

Once the primary winding has been charged to the desired energy necessary to generate a spark at the secondary winding, the solid-state switch is electronically opened. After opening the solid-state switch, the current at the primary winding is abruptly interrupted and the energy, previously stored in it, is released as a voltage pulse across the primary winding. Such a pulse may be equal to 200-400 Volts, for example.

The voltage variation across the primary winding generates an electric field, and therefore, there is a mutual inductance coupling with the secondary winding. The secondary winding is sized, for example, with a turns ratio N2/N1 of about 100. A voltage is generated in the secondary winding, which is about 100 times the voltage in the primary winding, and is about 20-40 kV. This voltage is applied to the spark plug connected to the secondary winding of the transformer. This is sufficient to generate a spark in the combustion chamber in which the spark is received.

If a plug is not present or does not perfectly operate when the solid-state switch is opened, a condition known as an open secondary occurs. The energy stored in the primary of the transformer cannot be usefully transferred to the transformer secondary. Consequently, the energy is dissipated in the primary winding. More particularly, the energy will be dissipated by the solid-state component operating as a switch.

This condition is particularly demanding for a solid-state component when the device operates in a current limiting condition. The current is a maximum current allowed by the ignition circuit configuration, and therefore, the energy to be dissipated takes a maximum value.

In addition, the problem of power dissipation from the solid-state switch is further exacerbated because the marketplace requires devices which are increasingly smaller in terms of their silicon and package areas. These factors reduce the thermal capacities instrumental to the dissipation process in case of an open secondary.

In light of what has been described beforehand regarding the thermal dissipation problems in the open secondary condition, this condition is a potential cause of breakdown of the electronic ignition circuit. The breakdown may be the solid-state power element acting as the switch, along with consequential damages of the portions which the electronic ignition circuit is connected to, such as the coil and the electronic unit, for example.

U.S. Published Patent Application No. 2004/0200463 describes a device for the ignition of internal combustion engines having, among other things, an IGBT transistor acting as a switch, a current limiting circuit, and an anomalies detecting circuit capable of detecting an anomaly in the ignition signal generated by an electronic control unit.

SUMMARY OF THE INVENTION

In view of the foregoing background, an object of the present invention is to reduce thermal dissipation problems in an open secondary condition of an electronic ignition circuit.

This and other objects, features and advantages in accordance with the present invention are provided by a control apparatus for an engine ignition spark plug comprising a switch comprising a control terminal and an output terminal both to be connected to an external transformer, with the switch having a closed state to supply a voltage to the transformer and an open state to release the voltage from the transformer to the spark plug. A measuring module may measure in the open state a time duration of a voltage at the output terminal decreasing from a first value to a second value. A detecting module may detects an operating condition of the spark plug based on comparing the measured time duration to a time threshold, and to generate a detecting signal based on the comparing.

Another aspect is directed to a method for operating a control apparatus for an engine ignition spark plug, wherein the control apparatus comprises a switch comprising a control terminal and an output terminal both connected to a transformer. The method comprises operating the switch in a closed state to supply a voltage to the transformer and in an open state to release the voltage from the transformer to the spark plug. The method may further comprise measuring in the open state a time duration of a voltage at the output terminal decreasing from a first value to a second value. An operating condition of the spark plug may be detected based on comparing the measured time duration to a time threshold, a detecting signal may be generated based on the comparing.

BRIEF DESCRIPTION OF THE DRAWINGS

Referring to the attached drawings, non-limiting embodiments will be described for a better understanding of the invention, wherein.

DETAILED DESCRIPTION OF THE PREFERRED EMBODIMENTS

Figure 1:
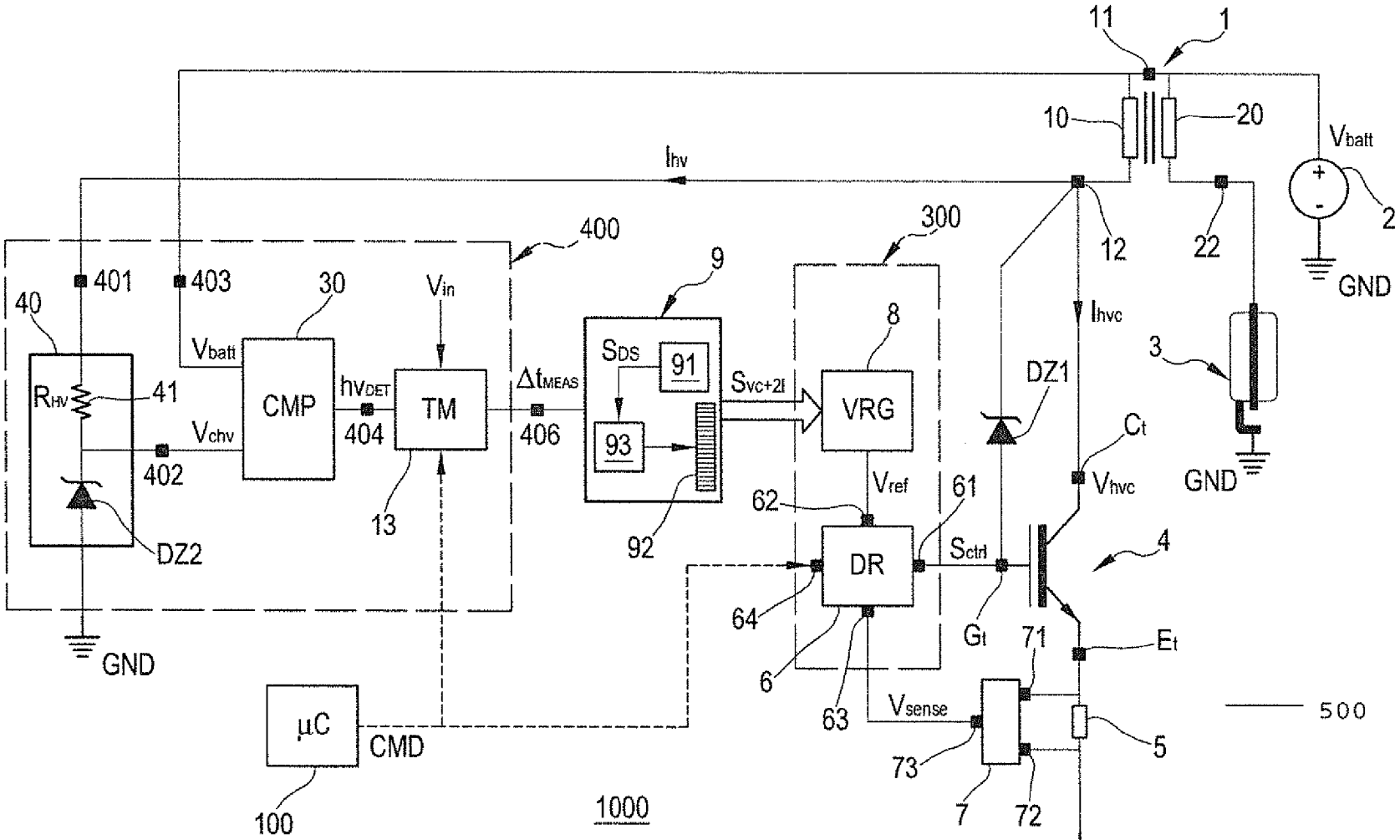
FIG. 1 schematically shows an electronic ignition system of an internal combustion engine comprising a spark plug, a solid-state switch, and an control apparatus of the switch in accordance with the present invention.

FIG. 1 shows a particular embodiment of an electronic ignition system 1000 of an internal combustion engine, such as an Otto cycle (i.e., four-stroke) engine, which may be used in motor vehicles, for example. Electronic ignition system 1000 comprises a control apparatus 500, an electrical transformer 1, a spark plug 3, and is supplied by an electrical voltage generator 2, such as a battery.

The electrical transformer 1 is provided with a primary winding 10 located between the polarizing terminal 11 and a primary terminal 12, and a secondary winding 20 located between a polarizing terminal 11 and a secondary terminal 22.

The polarizing terminal 11 is connected to a positive pole of the battery 2 generating a supplying voltage $V_{batt}$. A negative pole of the battery 2 is instead connected to a ground terminal gnd. Connected to the secondary terminal 22 is instead a central electrode of the spark plug 3 having a ground electrode connected to the ground terminal gnd. The electrical transformer 1 is adapted to store electrical energy in the primary winding 10 for discharging it in the secondary winding 20 to enable the spark plug 3 to generate an electrical spark.

The control apparatus 500 comprises a solid-state switch 4 having a control terminal $G_t$ and an output terminal $C_t$ connected to the electrical transformer 1. The solid-state switch 4 is configured to have a closing state to supply energy to the electrical transformer 1, and an opening state to release energy to the spark plug.

In the following, the solid-state switch 4 will also be referred to simply as a switch. The switch includes, for example, an IGBT (insulated gate bipolar transistor) type power transistor as shown in FIG. 1. The switch may also include Darlington configured bipolar transistors, or Trilinton configured bipolar transistors (i.e., three stages).

The switch 4 is configured to drive electrical current flowing through the primary winding 10. More specifically, the switch 4 is provided with a collector terminal $C_t$ to receive a collector current $I_{hvc}$ and supply a collector voltage $V_{hvc}$ referenced to the ground terminal gnd, and is connected to the primary terminal 12 of the electrical transformer 1. Further, the switch 4 is provided with an emitter terminal $E_t$ connected, for example, through a first terminal of a sensing resistor 5 (having resistance $R_{sense}$) with a corresponding second terminal connected to the ground terminal gnd.

The switch 4 is also provided with a gate terminal $G_t$ to receive a first driving signal $S_{ctrl}$ by which the collector current $I_{hvc}$ control is performed. Further, the control apparatus 500 is provided with a measuring module 400 configured to measure a time interval value $\Delta t_{MEAS}$ during which, in the switch 4 open state, a collector voltage $V_{hvc}$ decreases from a first maximum value to a second value.

According to a particular example, the measuring module 400 comprises a voltage detecting module 40, a comparing module 30, and a time detecting module 13. The voltage detecting module 40 is provided with a corresponding first input terminal 401 connected to the collector terminal $C_t$ of switch 4, and is configured to detect the collector voltage $V_{hvc}$ and supply this voltage to a first output terminal 402 as a reading signal $V_{rhv}$.

For example, the voltage detecting module 40 comprises a detecting resistor 41 having a resistance $R_{HV}$ connected across the first input terminal 401 and the first output terminal 402. Moreover, a Zener diode DZ2 is connected across the first output terminal 402 and the ground terminal gnd.

The comparing module 30 is connected to the first output terminal 402 for receiving the reading signal $V_{rhv}$, and is provided with a second input terminal 403 for receiving the supplying voltage $V_{batt}$, and with a second output terminal 404 for a comparing signal $hv_{DET}$. The illustrated comparing signal $hv_{DET}$ is a square-shaped wave. The comparing module 30 is configured to compare the reading signal $V_{rhv}$ with at least one threshold voltage depending on the supplying voltage $V_{batt}$.

Figure 2:
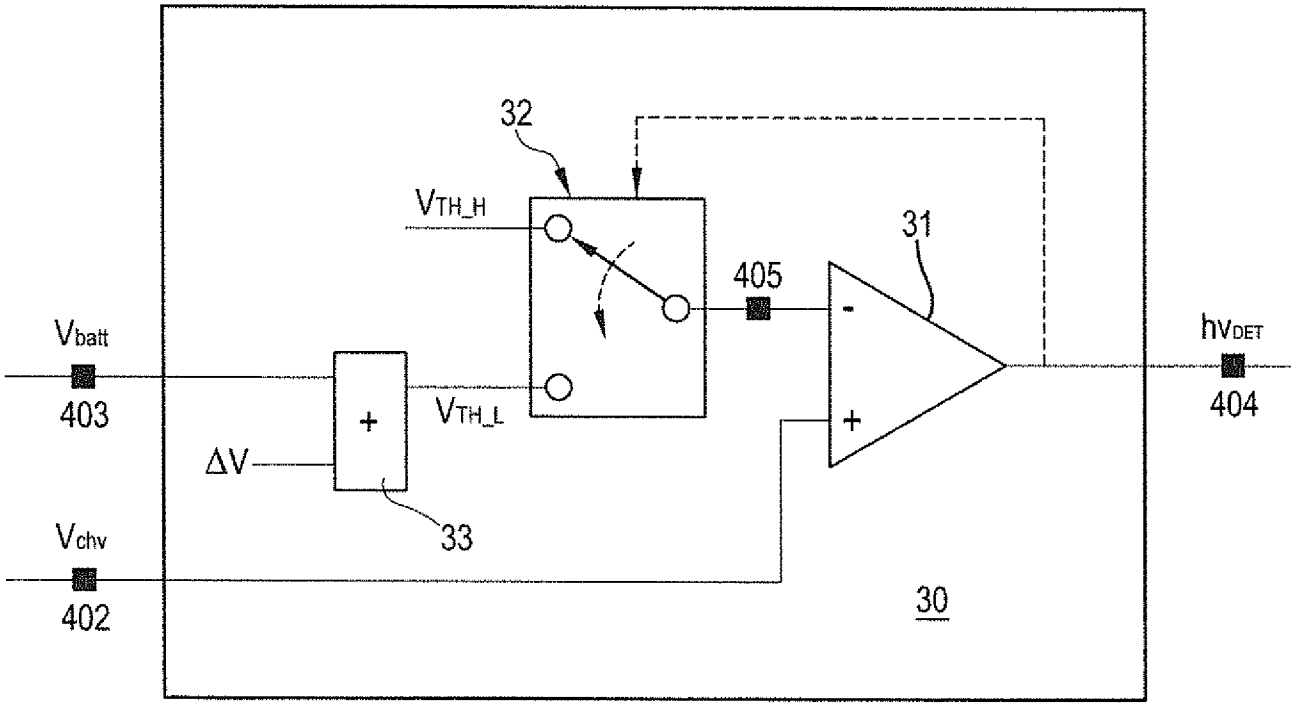
FIG. 2 schematically shows a comparing module used in the control apparatus shown in FIG. 1.

FIG. 2 shows a particular embodiment of the comparing module 30 comprising a comparator 31 provided with an inverting input –, a non-inverting input +, and a comparing output corresponding to the second output terminal 404 to make available the comparing signal $hv_{DET}$.

The inverting input of the comparator 31 is connected to a third output terminal 405 of a selection module 32 that is driven by the comparing signal $hv_{DET}$. The selection module 32 is capable of switching between a first configuration wherein it makes available at the third output terminal 405 a first threshold voltage VTH_H, and a second configuration wherein it makes available at the third output terminal 405 a second threshold voltage VTH_L. The second threshold voltage VTH_L is available at the output of a summing module 33 configured to sum an additional positive voltage $\Delta V$ to the supplying voltage $V_{batt}$, and therefore generate the second threshold voltage VTH_L.

Referring again to FIG. 1, the measuring module 400 is also provided with a time detecting module 13 having an input connected to the second output terminal 404 for receiving the comparing signal $hv_{DET}$. More particularly, the time detecting module 13 is configured to measure the time interval value $\Delta t_{MEAS}$ of the interval elapsing between a leading edge and the following trailing edge of the comparing signal $hv_{DET}$, and supply a corresponding signal representative of such a value at a fourth output terminal 406. The corresponding signal may be, for example, a digital signal.

The time detecting module 13 is further provided with another input terminal for receiving a driving signal CMD adapted to switch it on and off. Particularly, the time detecting module 13 is switched on at the trailing edge of the driving signal CMD, and is switched off at the end of the time interval $A\Delta_{MEAS}$ measurement (trailing edge of the comparing signal $hv_{DET}$). The time detecting module 13 is implemented, for example, by a counter and a clock.

The control apparatus 500 further comprises a detecting module 9 configured to detect anomalies in the spark plug 3 operation. This is based on the time duration value $\Delta t_{MEAS}$ as measured. The control apparatus 500 generates a detecting signal $SV_{ctrl}$, such as for example, a digital signal.

These spark plug anomalies correspond to "open secondary" situations, and therefore, to those situations wherein the spark plug 3 is not capable of generating the desired electrical spark, after one or more ignition attempts. The "open secondary" condition verifies when the spark plug 3 is not present, is damaged or is not correctly connected to the ignition system 1000.

More specifically, the detecting module 9 is configured to detect an anomaly in the spark plug 3 when the above-mentioned time duration $\Delta t_{MEAS}$ is less than a time threshold $T_{th}$. Further, the detecting module 9 is configured to detect a regular operating condition in the spark plug 3 when the time duration $\Delta t_{MEAS}$ is greater than the time threshold $T_{th}$. Under the regular operating condition, the spark plug 3 strikes the desired electrical spark to ignite the engine.

It is observed that, according to a first embodiment of the detecting module 9, the detecting signal $SV_{ctrl}$ is such to indicate the presence of an anomaly when it detects a spark absence condition for a number Ns of times (wherein number Ns is greater than or equal to 1). If the spark absence is detected for a number of times less than Ns, then the detecting signal $SV_{ctrl}$ indicates a regularity condition.

In the following description, the spark absence condition will be indicated as a NO SPARK condition, while the spark presence condition will be indicated as a SPARK condition. According to this first embodiment, the detecting module 9 can comprise, for example, a comparing digital module 91, a decision module 93 and an incrementable register 92.

More particularly, the comparing digital module 91 is configured to compare the time duration value $\Delta t_{meas}$ with the time threshold $T_{th}$ and supply a further comparing signal $S_{DS}$, which can take a first logic value (1, for example) in case of a NO SPARK condition, or a second logic value (0, for example) in case of a SPARK condition.

According to the example, the decision module 93 implements logic such that it increments (by one unit) a count value of the incrementable register 92 when the further comparing signal $S_{DS}$ indicates the presence of a consecutive number of NO SPARK conditions equal to the above-mentioned number Ns. In addition, the decision module 93 implements logic such that it resets the count value of the incrementable register 92 each time the further comparing signal $S_{DS}$ indicates the detection of a SPARK condition. The number Ns can be also equal to 1, and he count value is incremented by a single detection of a NO SPARK condition.

The incrementable register 92 is configured to store the count value $CN_i$, and generate the detecting signal $SV_{ctrl}$. According to this example, the detecting signal $SV_{ctrl}$ can take a plurality of digital values corresponding to the present content of the incrementable register 92. For example, the incrementable register 92 (and the detecting signal $SV_{ctrl}$) can take a plurality of count values CN=[0, 1, 2, . . . , Nc]. A first count value $CN_1$ (0, for example) is representative of a SPARK condition. Each of the following values is indicative of the repetition of a NO SPARK condition for a number of times equal to the product $Ns*CN_i$.

The control apparatus 500 also comprises a driving module 300 connected to the control terminal $G_t$ of the switch 4. The driving module 300 is configured to generate a first driving signal $S_{ctrl}$ for the switch 4 dependent on the detecting signal $SV_{ctrl}$.

More specifically, the first driving signal $S_{ctrl}$ is such to modify the switch 4 operating modes when the detecting module 9 detects an electrical absence or misfiring of the spark plug 3, or detects a plurality of consecutive electrical absences or misfirings of the electrical spark plug 3 following different engine ignition attempts.

More specifically, and with reference to the particular embodiment of FIG. 1, the driving module 300 comprises a voltage generation module 8 and a driving module and a current limiter 6. The voltage generation module 8 is configured to supply to a reference terminal 62 a reference signal, particularly a reference voltage $V_{ref}$, having a value dependent on the detecting signal $SV_{ctrl}$.

The voltage generation module 8 is, for example, a reference voltage generator and may be called a voltage reference. The voltage generation module 8 is of a known type, and generates electrical voltages having a substantially constant value as the load varies, as supply voltage fluctuations vary, and as the temperature varies.

According to the described example, the reference voltage $V_{ref}$ can take a number of different values based on the indicated value of the detecting signal $SV_{ctrl}$ applied at the input of the voltage generation module 8. The voltage generator 8 is configured so that the reference voltage $V_{ref}$ decreases when the detecting signal $SV_{ctrl}$ indicates an increment of the count value CN.

Increasing values CN=[0, 1, 2, . . . , Nc] taken by the detecting signal $SV_{ctrl}$ (in other words by count values) correspond to respective decreasing values of the reference voltage $V_{ref}=[V_{refM}, V_{ref1}, V_{ref2}, \ldots, V_{refm}]$ where $V_{refM}$ is a maximum value and $V_{refm}$ is a minimum value. Therefore, the voltage generator 8 operates also as a digital-analog converter capable of converting digital information associated to the detecting signal $SV_{ctrl}$ in an analog voltage that is in the reference voltage $V_{ref}$.

The current limiting module 6 (referred to simply as a limiting module) is configured to generate the first driving signal $S_{ctrl}$ to the drive switch 4. The control current flows through the primary winding 10 based on the reference signal $V_{ref}$, a measuring voltage $V_{sense}$, and based on the driving command CMD.

It is observed that the minimum value $V_{refm}$/supplied by the voltage generator 8, is selected so that for a reference voltage $V_{refm}$ equal to the minimum value $V_{refm}$, the first driving signal $S_{ctrl}$ ensures that in the closing state of the switch 4 there is a collector current $I_{hvc}$ sufficient to charge the primary winding 10 with energy suitable to generate a spark in the spark plug 3.

Further, the maximum vale $V_{refM}$ is selected so that at a reference voltage $V_{ref}$ equal to a maximum vale $V_{refM}$, the first driving signal $S_{ctrl}$ ensures that in the switch 4 closing state there is a collector current $I_{hvc}$ having a predetermined nominal value. The limiting module 6 is provided with a control terminal 61 connected to the gate terminal $G_t$ of the switch 4, and is adapted to supply the first driving signal $S_{ctrl}$ to a command terminal 64 for the command signal CMD and with a sensing terminal 63 for the measuring voltage $V_{sense}$.

The limiting module 6 is configured to compare the measuring voltage $V_{sense}$, representative of the voltage at emitter terminal $E_t$, and therefore, also of the voltage at the collector terminal $C_t$ of the switch 4, with the particular value taken by the reference voltage $V_{ref}$. The limiting module 6 generate the first driving signal $S_{ctrl}$. The first driving signal $S_{ctrl}$ is such to cause the switch 4 to operate in a linear area so that the collector current $I_{hvc}$ is limited. Under these conditions, the measuring voltage $V_{sense}$ is regulated so that it is equal to the reference voltage $V_{ref}$ value.

The limiting module 6 can be implemented by an electronic circuit comprising a current generator for driving the gate terminal $G_t$ of the switch 4 and a current limiting circuit. The current limiting circuit is, for example, of a conventional type.

The control apparatus 500 further comprises a voltage sensing module 7 configured to measure the voltage drop across the sensing resistor 5 and supply this measurement by a corresponding measurement signal, such as the measuring voltage $V_{sense}$. The sensing resistor 5 is connected across the emitter terminal $E_t$ of the switch 4, and the ground terminal gnd.

The voltage sensing module 7 is provided with a first sensing terminal 71 and a second sensing terminal 72 connected to the first and second terminals of the sensing resistor 5, respectively, and with a measurement terminal 73 adapted to supply the measuring voltage $V_{sense}$. An additional Zener diode DZ1 has its anode connected to the gate terminal $G_t$ of the switch 4, and its cathode connected to the collector terminal $C_t$ of the switch 4 to limit the collector voltage $V_{hvc}$ to avoid the breakdown phenomenon in the switch 4.

The control module 100, which is external the electronic ignition device 1000 and may be a microcontroller, for example, is configured to generate the command signal CMD. The command signal CMD commands the switch 4 between closing and opening states.

In the following, an example of operation of the electronic ignition system 1000, and therefore also of the control apparatus 500, will be provided. The control module 100 generates the command signal CMD as a square-shaped wave, for example. The time interval $T_{on}$, in which the signal keeps a high value, is for example, equal to 4 ms. The time interval $T_{off}$, in which the signal keeps a low value, is for example, equal to 16 ms. The value of a period of the square wave T is equal to 20 ms, and the duty cycle value is equal to 20%.

The present description of the electronic ignition system 1000 operation relates to a generic portion of the command signal CMD which refers to four ignition cycles 1, 2, 3, 4. Between two following leading edges of the command signal CMD there is an ignition cycle or an attempted engine ignition, and therefore, a closure and the following opening of the switch 4.

Figure 3:
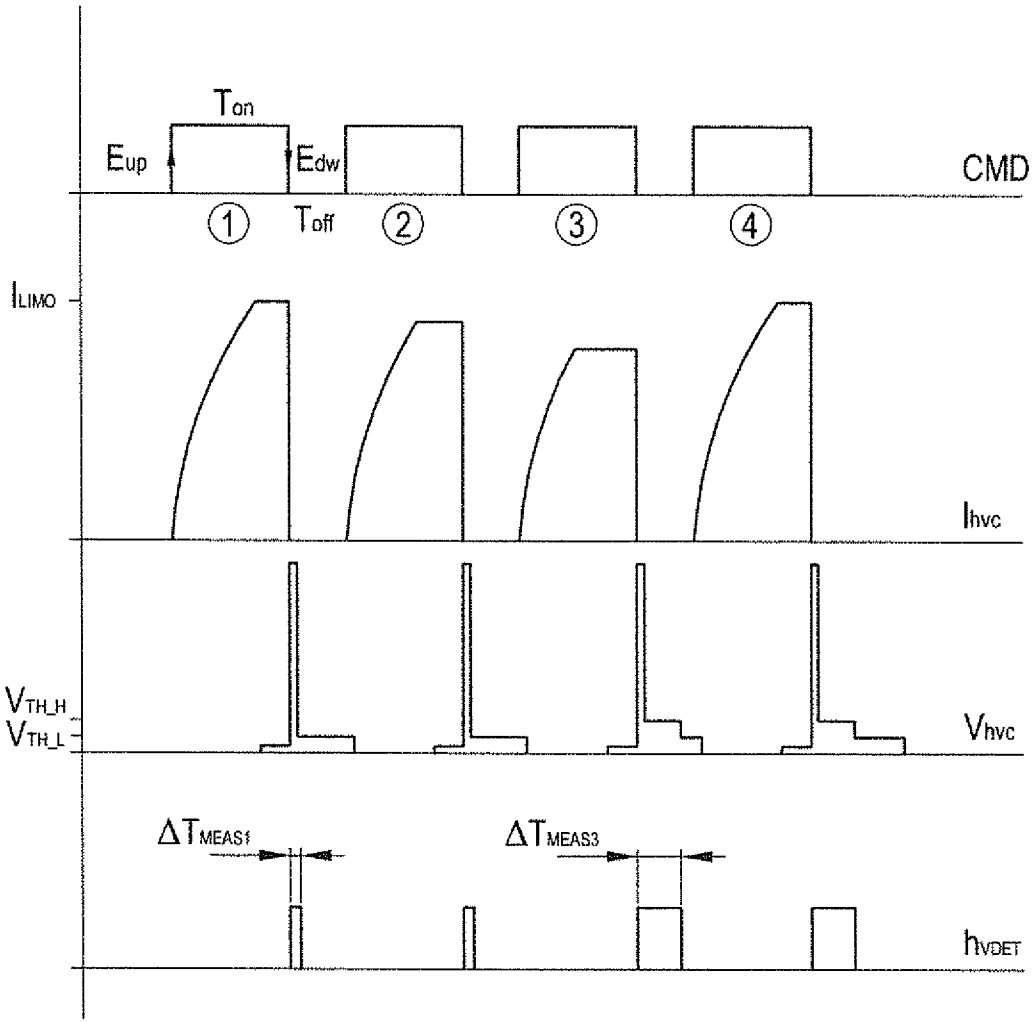
FIG. 3 schematically shows a trend of signals and electrical quantities characterizing operation of the ignition system in FIG. 1.

A first leading edge $E_{up}$ of the command signal CMD causes the limiting module 6 to close the switch 4. That is, according to the example, determines the switching on of the IGBT transistor. The IGBT transistor 4 switching on determines the start of the collector current $I_{hvc}$ flow. Then, at the leading edge $E_{up}$, the command signal CMD is kept at a high level for a time interval duration $T_{on}$ which causes an increasing trend of the collector current $I_{hvc}$, as shown in FIG. 3.

During the interval $T_{on}$, the collector current $I_{hvc}$ flows through the emitter terminal $E_t$ of the switch 4, and from it, flows in the sensing resistor 5 by causing a voltage drop across its terminals. The voltage drop across the sensing terminal 5, having resistance $R_{sense}$, is measured by the voltage sensing module 7 which therefore supplies the corresponding measuring voltage $V_{sense}$ in the limiting module 6.

The limiting module 6 compares the reference voltage $V_{ref}$ with the measuring voltage $V_{sense}$, which has an increasing trend proportional to the collector current $I_{hvc}$ flowing in the sensing resistor 5 according to $V_{sense}=R_{sense}*I_{hvc}$. When the measuring voltage $V_{sense}$ is greater than a threshold value suitably less than the reference voltage $V_{ref}$, the limiting module 6 adjusts the voltage at the gate terminal $G_t$ of the switch 4 to limit the intensity of the collector current $I_{hvc}$ to a nominal current limiting value $I_{LIM0}$.

During the interval $T_{on}$, the collector current $I_{hvc}$, except for contribution of the current $I_{hv}$ supplying the voltage detecting module 40, flows through the primary winding 10. The collector current $I_{hvc}$ charges it to an energy value equal to $L\,I^2_{hvc}/2$, where L is the inductance value of the primary winding 10.

At the end of the interval $T_{on}$, when the collector current $I_{hvc}$ has already taken a nominal limiting value $I_{LIM0}$, the collector voltage $V_{hvc}$ of the switch 4 is equal to the battery voltage $V_{batt}$.

At the trailing edge $E_{dw}$, the control signal CMD causes the limiting module 6 to open the switch 4 so that it determines the IGBT transistor switching off. Since the switch 4 has been opened, the collector voltage $V_{hvc}$ rapidly increases, as shown in FIG. 3. The increment of the collector voltage $V_{hvc}$ value at the collector terminal can possibly be limited by the action of the additional Zener diode DZ1 to avoid the break-down phenomenon in the switch 4.

The peak value of the collector voltage $V_{hvc}$ during the opening of the switch 4 is, for example, between 300 V and 400 V. It is observed that the collector voltage $V_{hvc}$, except for the battery voltage $V_{batt}$, corresponds to the voltage in the primary winding 10. Due to the inductive coupling between the primary winding 10 and the secondary winding 20, a voltage is generated in the secondary winding 20 having a value determined by the turns ratio of the electrical transformer 1. For example, assuming a turns ratio equal to 100, and a primary winding 10 voltage between 300 V and 400 V, the voltage arising in the secondary winding 20 is between 30 kV and 40 kV.

In the presence of the spark plug 3 and of its correct operation, the voltage generated in the secondary winding 20 is applied to the central electrode of the spark plug 3 so that a spark is generated inside the combustion chamber. Therefore, the energy stored in the primary winding 10 is released to the secondary winding 20. This operating condition is indicated, as stated above, as the SPARK condition.

Instead, in case of an absence of the spark plug 3 absence, or a malfunction of the same, the spark is not generated inside the combustion chamber. Consequently, the energy stored in the primary winding 10 is not released to the secondary winding 20. As a consequence of this operating condition, a NO SPARK condition is present. The energy stored in the primary winding will be dissipated by the switch 4 according to the modes that will be described in the following paragraphs.

One case is during cycle 1, as in FIG. 3, where a NO SPARK condition exists. At the trailing edge $E_{down}$ of the command signal CMD, the comparing module 30 compares the reading signal $V_{rhv}$, representative of the collector voltage $V_{hvc}$, supplied by the detecting module 40, with the first threshold voltage VTH_H delivered by the selection module.

The value of the first threshold voltage VTH_H is set so that at the opening of the switch 4, the reading signal $V_{rhv}$ exceeds the value of the first threshold voltage VTH_H. Until the reading signal $V_{rhv}$ is less than the first threshold voltage VTH_H value, the comparing signal $hv_{DET}$ takes a first logic value, 0 for example.

The reading signal $V_{rhv}$ follows the trend of the collector voltage $V_{hvc}$ occurring from the instant in which the switch 4 is opened. The collector voltage $V_{hvc}$ has a peak and rapidly decreases due to the dissipation occurring in the switch 4 if the latter is in an open state.

From the instant at which the reading signal $V_{rhv}$ exceeds, by increasing, the first threshold voltage VTH_H value, the comparing signal $hv_{DET}$ switches to a second logic value, 1 for example. It is noted that under both a SPARK condition and a NO SPARK condition, the comparing signal $hv_{DET}$ will not further switch and, therefore, it will keep the logic value 1 until a substantially complete dissipation of the energy stored in the primary winding 10 occurs.

The comparing signal $hv_{DET}$ switching, from logic value 0 to logic value 1, causes the selection module 32 to switch and supply to the comparator 31 the second threshold voltage VTH_L, whose expected value is less than the first threshold voltage VTH_H. Moreover, the comparing signal $hv_{DET}$, by switching from logic value 0 to logic value 1, activates a process of the measuring time duration $\Delta t_{MEAS}$ between two following edges of the comparing signal $hv_{DET}$ performed by the time detecting module 13.

Until the reading signal $\backslash I_{rhv}$ remains above the second threshold voltage VTH_L, the comparing signal $hv_{DET}$ remains equal to the logic value 1. Then, when the reading signal $V_{rhv}$ decreases below the second threshold voltage VTH_L, the comparing signal $hv_{DET}$ switches to the logic value 0. This occurs when the collector voltage $V_{hvc}$ decreases due to the dissipation in the switch 4.

When the comparing signal $hv_{DET}$ switches from the logic value 1 to the logic value 0, the time detecting module 13 passes through the process of measuring the time duration $\Delta t_{MEAS}$ between two following edges of the comparing signal $hv_{DET}$. This makes available the measured value $\Delta t_{MEAS1}$ in the detecting module 9.

The comparing digital module 91 of the detecting module 9 receives at its input the measured time duration $\Delta t_{MEAS1}$ value and compares it with the time threshold $T_{th}$ suitably selected. This is to discriminate between two possible operating conditions, the SPARK condition or NO SPARK condition.

To this end, a time interval $t_{HV}$ is defined as the time interval wherein the collector voltage $V_{hvc}$ remains below the second threshold voltage VTH_L. For the SPARK conditions, the time interval takes value $t_{HV}$(SPARK), which is greater than the value $t_{HV}$(NO SPARK), which is the case for a NO SPARK condition:

$$t_{HV}(\text{SPARK})>t_{HV}(\text{NO SPARK})$$

Typically, but not in a limiting way, the value $t_{HV}$(SPARK) is between 0.8 ms and 2 ms, and the value $t_{HV}$(NO SPARK) is not greater than 0.3 ms. According to this example, the above mentioned threshold time $T_{th}$ can be selected in the range from 0.3 to 0.8 (0.5 msec, for example).

Referring to cycle 1 in FIG. 3, the measured time duration $\Delta t_{MEAS1}$ is less than the time threshold $T_{th}$, and therefore, the time comparing module 91 detects a NO SPARK operating condition, and generates an additional comparing signal $S_{DS}$. The additional comparing signal $S_{DS}$ takes, for example, a first logic value 1. The additional comparing signal $S_{DS}$ is made available to the decision module 93. Moreover, it is considered that for the particular case where Ns is equal to 1, and the incrementable register 92 is incremented by one unit for each single detection of a NO SPARK condition.

Therefore, due to this logic value 1, taken by the additional comparing signal $S_{DS}$, the decision module 93 increments one unit the content of the incrementable register 92, and consequently, the digital value represented by the detecting signal $SV_{ctrl}$ is incremented.

The value of the incrementable register 92, as determined this way, is made available to the voltage generating module 8 by an update of the value taken by the detecting signal $SV_{ctrl}$ based on the new count value taken by the incrementable register 92.

On the basis of the value taken by the detecting signal $SV_{ctrl}$, the voltage generation module 8 generates a new value $V_{ref1}$ of the reference voltage $V_{ref}$. The new value $V_{ref1}$ of the reference voltage $V_{ref}$ is less than the value of the reference voltage $V_{ref}$ previously taken.

In this way, in the following cycle 2 of the ignition and opening of the switch 4, the limiting module 6 generates the second driving signal $S_{ctrl}$ having a value so that the collector current $I_{hvc}$ will have a maximum value reduced with respect to the one occurring in the previous cycle.

Moreover, as it is apparent from FIG. 3, both the reference voltage and a maximum value of the collector current $I_{hvc}$ decreases (within predetermined ranges) in cycle 2 with respect to cycle 1. According to the shown example, also in cycle 2, a NO SPARK condition occurs with a further reduction of the maximum collector current $I_{hvc}$ (a limiting current) in following cycle 3.

It is observed that in these consecutive NO SPARK conditions, reducing the maximum current in the switch 4 in an open condition decreases the energy dissipated in the switch 4, and consequently, reduces the stress applied to it in case of an anomaly in the spark plug 3 operation.

According to the example shown in FIG. 3, in cycle 3 it is verified that the time duration $\Delta t_{MEAS3}$ is higher than or equal to the time threshold value $T_{th}$, and therefore, the detecting module 9 detects a SPARK operating condition and resets the count value stored in the incrementable register 92.

The reset value of the incrementable register 92 is made available to the voltage generating module 8 by a further update of the value taken by the detecting signal $SV_{ctrl}$. On the basis of the value taken by the updated detecting signal $SV_{ctrl}$, the voltage generating module 8 generates the reference voltage $V_{ref}$ having value $V_{max}$. Therefore, in the following ignition cycle, that is cycle 4, the collector current $I_{hvc}$ could take the predetermined maximum nominal value. This exemplifying situation shown by cycles 1, 2, 3 and 4 in FIG. 3 can occur, for example, when the spark plug is fouled, and therefore, it can happen that after a certain number of unsuccessful attempts, at last a spark strikes.

It is observed that, according to a further embodiment, it is possible to consider a case wherein the switch 4 is prevented from closing after the occurrence of a predetermined number of consecutive NO SPARK conditions (Ns being greater than or equal to 1). For example, an additional counter is provided to count the number of times a number of NO SPARK conditions equal to Ns is detected. Further, in this case, the command module 100 can prevent additional cycles of switching on and off the switch 4. This approach enables prevention of the switch 4 from breaking down.

The electronic ignition has a very important function for the safety of a vehicle since a switch 4 breakdown, besides preventing a cylinder from operating, could also cause also serious breakdowns. In some cases, a fire or serious damages to the coil or central unit could occur.

A thermal model of an IGBT has been implemented to test its performance in case of a failed spark, and for a collector current trend analogous to the one obtained in the described ignition system 1000. One is also obtained according to the prior art without a limiting current reduction as the number of no-spark cycles increases.

Figure 4:
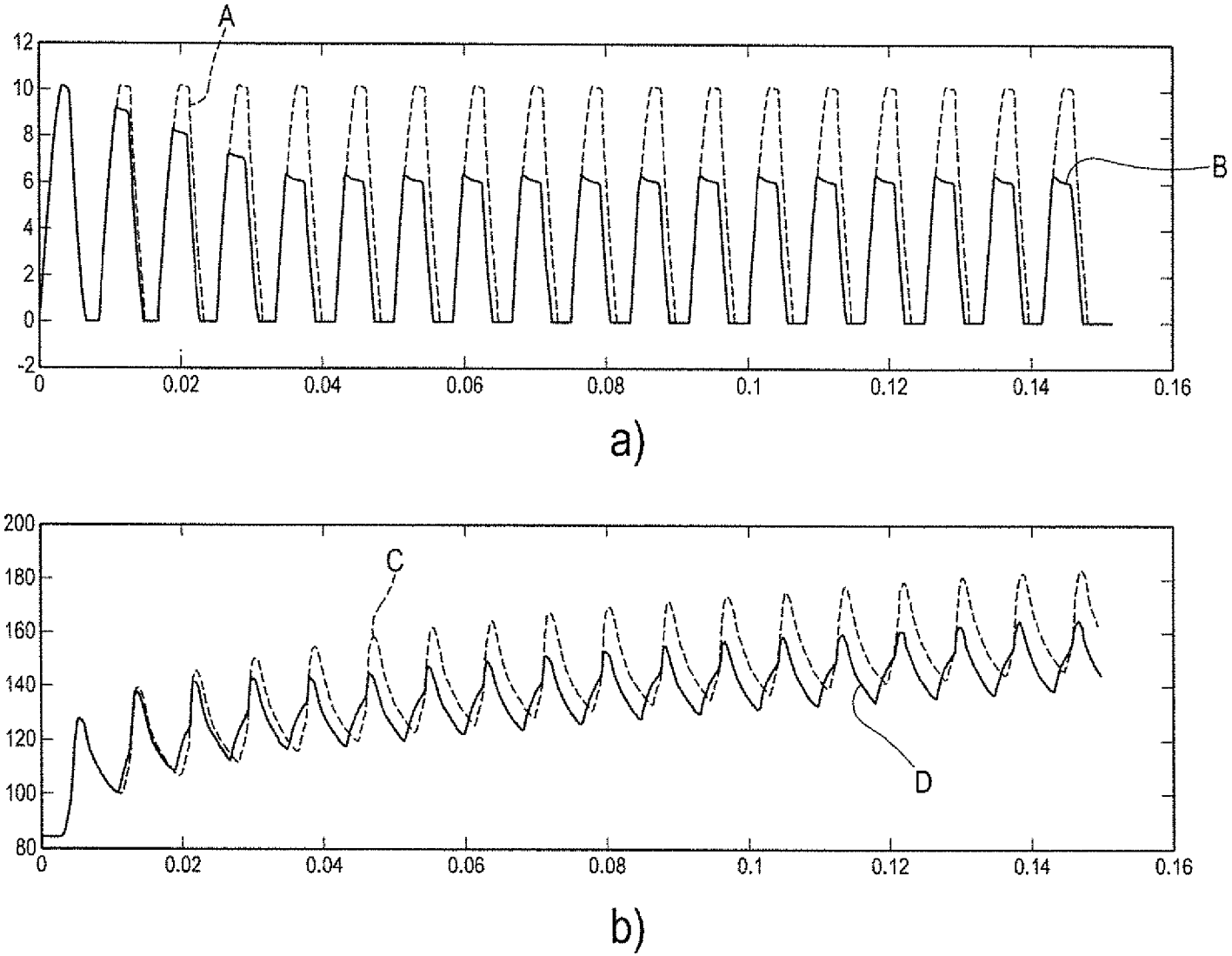
FIG. 4*a* shows a first curve A relative to a trend of an electrical current in a solid-state switch occurring in an electronic ignition system of the prior art during an open secondary event, and a second curve B relative to a trend of the collector current in the solid-state switch occurring in the ignition system of FIG. 1 in the same operating conditions.
FIG. 4*b* shows a third curve C and a fourth curve D both referring to a trend as a function of time and temperature in the solid-state switch junction for corresponding currents having the trend of curves A and B, respectively.

More specifically, FIG. 4*a* shows a first curve A of the collector current trend for several ignition cycles in an open secondary. This may always be an active limiting current condition. FIG. 4*b* shows a second curve B of the collector current $I_{hvc}$ trend for several ignition cycles, as it occurs in the described ignition system 1000. Curve A shows the absence of a reduction of the limiting current which appears instead in curve B.

In FIG. 4*d*, a third curve C and a fourth curve D refer to a trend as a function of the time and a junction temperature of an IGBT 4 for the collector currents having the trend of curves A and B, respectively. By observing curves C and D, it is noted that within about 150 ms the junction temperature reached by the IGBT 4 for a collector current following the trend of the second curve B is about 20° C. less than the one reached by an IGBT supplied by a current having the trend of first curve A.

Figure 5:
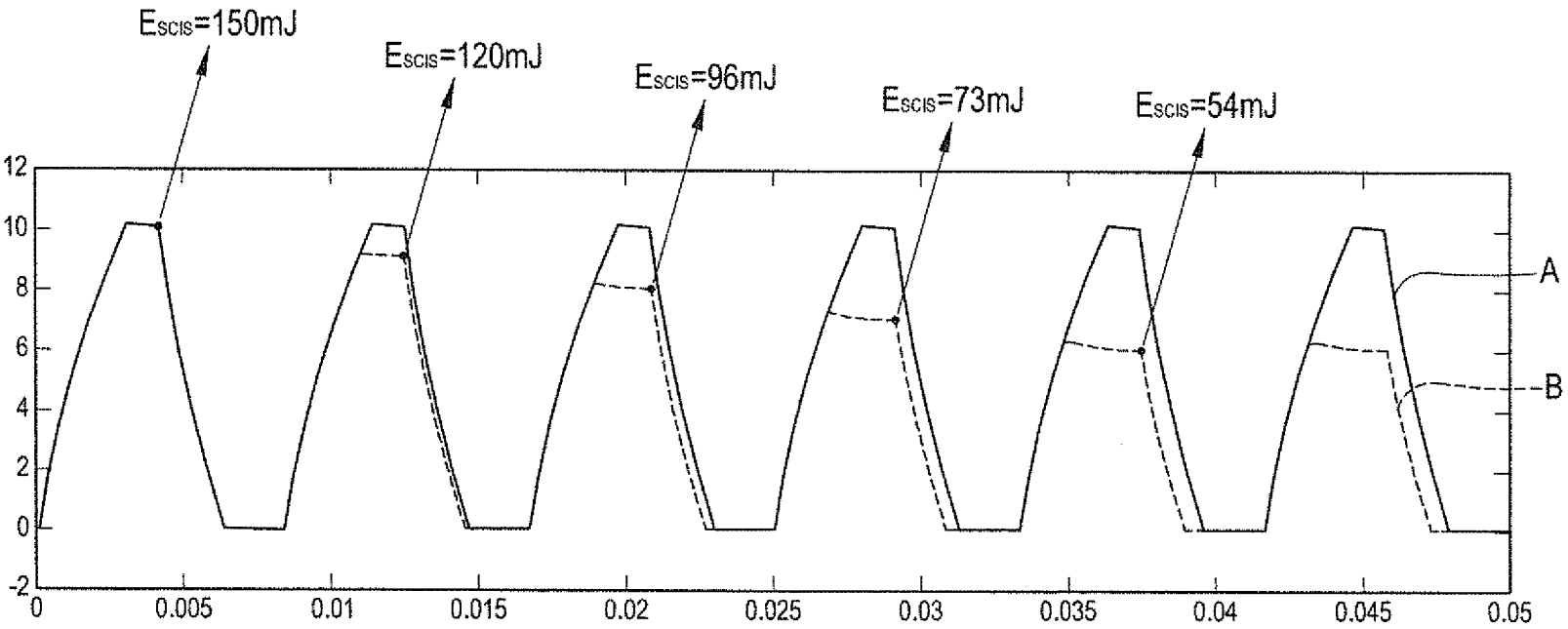
FIG. 5 shows the corresponding electrical energy to be dissipated for different values of the limiting current which the solid-state switch is subjected to as shown in FIG. 1.

Moreover, FIG. 5 shows again the first curve A and the second curve B, and in addition, indicates for each different value of a limiting current of the two above-mentioned curves, where the corresponding electrical energy $E_{SCIS}$ to be dissipated. As it will be appreciated from FIG. 5, in the considered example, the minimum value of the limiting current entails an energy to be dissipated equal to 54 mJ. In other words, a value about three times less than the one to be dissipated for a limiting maximum current value equal to 150 mJ.

The above mentioned ignition system 1000 and control apparatus 500 have several advantages in comparison with the prior art systems. Particularly, a reduction of the maximum temperature reached by the junction of the solid-state switch and a reduction of the electrical energy to be dissipated in operating anomalies in the spark plug. This allows the life of a solid-state switch to be extended, and also enables smaller size (less expensive) and faster solid-state switches providing the same performance, despite the smaller switches being less efficient from a heat dissipation point of view.

The invention claimed is:

1. A control apparatus for an engine ignition spark plug comprising:

a switch comprising a control terminal and an output terminal both to be connected to an external transformer, said switch having a closed state to supply a voltage to the transformer and an open state to release the voltage from the transformer to the spark plug;

a measuring module configured to measure in the open state a time duration of a voltage at the output terminal decreasing from a first value to a second value;

a detecting module configured to detect an operating condition of the spark plug based on comparing the measured time duration to a time threshold, and to generate a detecting signal based on the comparing; and a driving module connected to the control terminal and configured to generate a driving signal for said switch based on the detecting signal;

said detecting module configured to detect a first anomaly condition corresponding to a failed electrical spark of the spark plug, and a second anomaly condition corresponding to more than one failed electrical spark of the spark plug, with the driving signal to modify an operating mode of said switch based on detecting the first and second anomaly conditions.

2. The control apparatus according to claim 1, wherein said measuring module comprises:

a measuring sensor connected to said output terminal and configured to generate a reading voltage; and a comparing module configured to compare a supply voltage coupled to the external transformer with the reading voltage, and to generate a first comparing signal based on the comparing.

3. The control apparatus according to claim 2, wherein said measuring module further comprises a time detecting module configured to generate a time duration value corresponding to a time duration of the first comparing signal.

4. The control apparatus according to claim 3, wherein said detecting module comprises a time comparing module configured to compare the time duration value with the time threshold, and to generate a second comparing signal having a first value representative of a failed spark of the spark plug if the time duration value is less than the time threshold; and a second value representative of a successful spark of the spark plug if the time duration value is greater than the time threshold.

5. The control apparatus according to claim 4, wherein said detecting module further comprises a register configured to increment a count value therein when the second comparing signal takes a value that is one or more times the first value, and provides the detecting signal based on the count value.

6. The control apparatus according to claim 5, wherein said driving module comprises:

a reference voltage generator configured to receive the detecting signal and generate a corresponding electrical reference voltage; and an electrical current limiting circuit configured to generate the driving signal as a function of the reference electrical voltage, and to adjust an electrical current at the output terminal of said switch.

7. The control apparatus according to claim 6, wherein said detecting module and said reference voltage generator are configured so that the reference electrical voltage decreases when the detecting signal indicates an increment of the count value.

8. The control apparatus according to claim 7, wherein said detecting module is configured so that the reference electrical voltage takes a value between a minimum voltage value that is greater than a minimum voltage necessary for generating a spark in the spark plug, and a maximum voltage value corresponding to a predetermined electrical current at the collector terminal.

9. The control apparatus according to claim 7, further comprising an electrical voltage sensing device comprising:

at least one first terminal connected to an additional output terminal of said switch for receiving a voltage;

a second terminal for providing to the current limiting circuit a detected voltage indicating the voltage being drawn; and said current limiting circuit being configured to compare the reference voltage with the detected voltage, and to generate the corresponding driving signal for the switch.

10. The control apparatus according to claim 1, wherein said switch comprises at least one of a Darlington transistor, a three-stage transistor, and an IGBT transistor.

11. An electronic ignition system for an internal combustion engine comprising:

a spark plug;

a transformer having a primary winding, and a secondary winding connected to said spark plug; and a control apparatus connected to the primary winding and comprising a switch comprising a control terminal and an output terminal both connected to the primary winding of said a transformer, said switch having a closed state to supply a voltage to said transformer and an open state to release the voltage from said transformer to said spark plug, a measuring module configured to measure in the open state a time duration of a voltage at the output terminal decreasing from a first value to a second value, a detecting module configured to detect an operating condition of said spark plug based on comparing the measured time duration to a time threshold, and to generate a detecting signal based on the comparing, and a driving module connected to the control terminal and configured to generate a driving signal for said switch based on the detecting signal, said detecting module configured to detect a first anomaly condition corresponding to a failed electrical spark of said spark plug, and a second anomaly condition corresponding to more than one failed electrical spark of said spark plug, with the driving signal to modify an operating mode of said switch based on detecting the first and second anomaly conditions.

12. The electronic ignition system according to claim 11, further comprising a control module coupled to said control apparatus to control ignition timing of said spark plug.

13. The electronic ignition system according to claim 11, wherein said measuring module comprises:

a measuring sensor connected to said output terminal and configured to generate a reading voltage;

a comparing module configured to compare a supply voltage coupled to the external transformer with the reading voltage, and to generate a first comparing signal based on the comparing; and a time detecting module configured to generate a time duration value corresponding to a time duration of the first comparing signal.

14. The electronic ignition system according to claim 13, wherein said detecting module comprises:

a time comparing module configured to compare the time duration value with the time threshold, and to generate a second comparing signal having a first value representative of a failed spark of said spark plug if the time duration value is less than the time threshold, and a second value representative of a successful spark of said spark plug if the time duration value is greater than the time threshold; and a register configured to increment a count value therein when the second comparing signal takes a value that is one or more times the first value, and provides the detecting signal based on the count value.

15. The electronic ignition system according to claim 14, wherein said driving module comprises:

a reference voltage generator configured to receive the detecting signal and generate a corresponding electrical reference voltage; and an electrical current limiting circuit configured to generate the driving signal as a function of the reference electrical voltage, and to adjust an electrical current at the output terminal of said switch.

16. A method for operating a control apparatus for an engine ignition spark plug, the control apparatus comprising a switch comprising a control terminal and an output terminal both connected to a transformer, the method comprising:

operating the switch in a closed state to supply a voltage to the transformer and in an open state to release the voltage from the transformer to the spark plug;

measuring in the open state a time duration of a voltage at the output terminal decreasing from a first value to a second value; and detecting an operating condition of the spark plug based on comparing the measured time duration to a time threshold;

generating a detecting signal based on the comparing; and generating a driving signal for the switch based on the detecting signal;

with the detecting comprising detecting a first anomaly condition corresponding to a failed electrical spark of the spark plug, and a second anomaly condition corresponding to more than one failed electrical spark of the spark plug, with the driving signal modifying an operating mode of the switch based on detecting the first and second anomaly conditions.

17. The method according to claim 16, wherein the control apparatus comprises a measuring module performing the measuring, the measuring module comprising:

a measuring sensor connected to the output terminal and configured to generate a reading voltage, and a comparing module configured to compare a supply voltage coupled to the external transformer with the reading voltage, and to generate a first comparing signal based on the comparing; and a time detecting module configured to generate a time duration value corresponding to a time duration of the first comparing signal.

18. The method according to claim 17, wherein the control apparatus comprises a detecting module performing the detecting and generating, the detecting module comprising:

a time comparing module configured to compare the time duration value with the time threshold, and to generate a second comparing signal having a first value representative of a failed spark of the spark plug if the time duration value is less than the time threshold, and a second value representative of a successful spark of the spark plug if the time duration value is greater than the time threshold; and a register configured to increment a count value therein when the second comparing signal takes a value that is one or more times the first value, and provides the detecting signal based on the count value.

19. The method according to claim 18, wherein the control apparatus comprises a driving module generating the driving signal, the driving module comprising:

a reference voltage generator configured to receive the detecting signal and generate a corresponding electrical reference voltage; and an electrical current limiting circuit configured to generate the driving signal as a function of the reference electrical voltage, and to adjust an electrical current at the output terminal of the switch.

* * * * *